United States Patent [19]

Barrios

[11] Patent Number: 5,000,380

[45] Date of Patent: Mar. 19, 1991

[54] LETTER RETAINING AND PROTECTING DEVICE

[76] Inventor: Gustavo R. Barrios, 616 Spartan La., Kenner, La. 70065

[21] Appl. No.: 456,501

[22] Filed: Dec. 26, 1989

[51] Int. Cl.[5] ..... B65D 91/00

[52] U.S. Cl. ..... 232/17; 232/1 C; 232/19

[58] Field of Search ..... 232/17, 19, 20, 1 C; 211/88

[56] References Cited

U.S. PATENT DOCUMENTS

| | | | |
|---|---|---|---|
| 1,842,501 | 1/1932 | Betz | 232/1 C |
| 2,498,361 | 2/1950 | Davis | 232/17 |
| 2,508,453 | 5/1950 | Giesler . | |
| 2,559,822 | 7/1951 | Kelly | 232/19 |

*Primary Examiner*—Robert W. Gibson, Jr.
*Attorney, Agent, or Firm*—George A. Bode

[57] ABSTRACT

A receptacle adapted to be mounted on the exterior of a mailbox for protection and retention of articles of mail comprising: a housing open at the bottom and of a generally triangular shape in cross-section having front and rear walls pivotally connected at their upper edges; sidewalls laterally depending from each edge of the front and sidewalls, the front and rear walls being biased to a first position, wherein the sidewalls depending from the front wall overlap the sidewalls depending from corresponding edges of the rear wall; and, projections depending interiorly laterally of the front and rear walls in resilient engagement for detachably securing an article of mail in suspended position within the housing.

8 Claims, 3 Drawing Sheets

LETTER RETAINING AND PROTECTING DEVICE

The invention claimed herein is disclosed in Disclosure Document No. 226209 filed May 4, 1989 and copending design application Ser. No. 07/420,133 filed Oct. 10, 1989.

BACKGROUND OF THE INVENTION

1. Field of the Invention

The apparatus of the present invention relates to devices for the protection and retention of articles of mail and, more specifically, to such devices that are mounted to the exterior of mailboxes and secure the mail while protecting it from the elements.

2. General Background

Heretofore, various many devices have been made for holding articles of mail within a box. Some examples of such devices are disclosed in the following U.S. patents:

| U.S. Pat. No. | Issue Date | Inventor(s) |
|---|---|---|
| No. 359,458 | March 15, 1887 | W. A. Moore |
| No. 1,013,128 | January 2, 1912 | E. H. Clark |
| No. 1,052,062 | February 4, 1913 | J. S. Johnson |
| No. 1,071,082 | August 26, 1913 | F. R. Peck |
| No. 1,104,883 | July 28, 1914 | F. C. Giesler |
| No. 1,250,998 | December 25, 1917 | J. E. Embrey |
| No. 1,295,624 | February 25, 1919 | A. T. Smith |
| No. 2,508,453 | May 23, 1950 | R. W. Gieseler |
| No. 2,829,820 | April 8, 1958 | A. F. Evers |
| No. 3,762,632 | October 2, 1973 | H. C. Voegeli |
| No. 4,069,965 | January 24, 1978 | H. H. Maddox, Jr. |

More specifically, in Geiseler's U.S. Pat. No. 2,508,453, a device for removably securing articles of mail in a suspended position within the interior of a mailbox is disclosed.

The apparatus of the present invention differs in several respects from the previously disclosed devices by providing, in the preferred embodiment, a transparent housing open at the bottom for easy access thereto and means for detachably securing articles of mail in a suspended position within the housing. The present invention allows for attachment to existing residential mailboxes. The apparatus of the present invention holds incoming or outgoing articles of mail and protects them from the elements in a manner not heretofore described.

SUMMARY OF THE PRESENT INVENTION

The preferred embodiment of the apparatus of the present invention solves the aforementioned problems in a straightforward and simple manner. What is provided is a receptacle adapted to be mounted on the exterior of a mailbox for protection and retention of articles of mail therein comprising: a hollow, transparent housing open at the bottom and of a generally triangular shape in cross-section having front and rear walls pivotally connected at their upper edges and sidewalls laterally depending from each side edge of the front and rear walls. Biasing means maintain the front and rear walls in a first position wherein the sidewalls overlap each other at the corresponding edges of the front and rear walls. Means is provided for detachably securing the article of mail in a suspended position within the housing.

BRIEF DESCRIPTION OF THE DRAWINGS

For a further understanding of the nature and objects of the present invention, reference should be had to the following description taken in conjunction with the accompanying, drawing in which like parts are given like reference numerals and, wherein.

DETAILED DESCRIPTION OF THE PREFERRED EMBODIMENT

Figure 1:
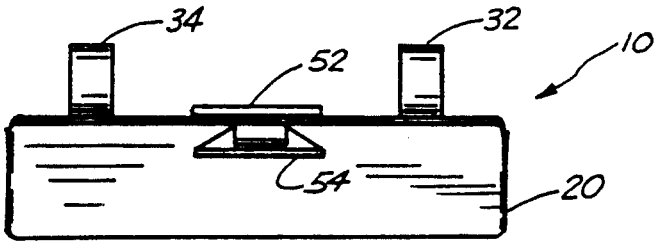
FIG. 1 is a top plan view of the preferred embodiment of the device of the present invention.
Figure 2:
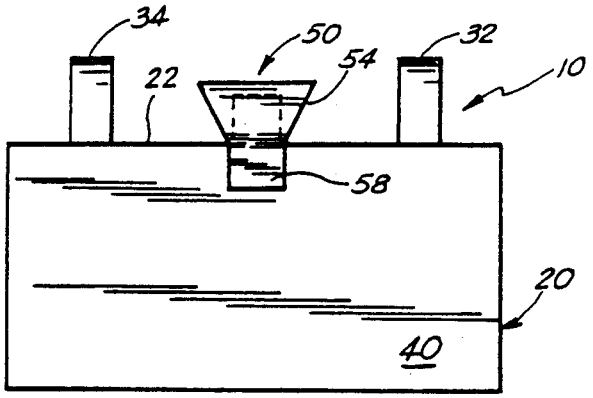
FIG. 2 is a front elevational view of the embodiment of FIG. 1.

Referring now to the drawings, and in particular FIGS. 1–8, the apparatus of the present invention is designated generally by the numeral 10. Apparatus 10 is a receptacle adapted to be mounted on the exterior of a mailbox 80 for protecting and retaining articles of mail. Receptacle 10 is comprised of a hollow, preferably transparent, housing 20. Housing 20, as best seen in FIGS. 1–6, has generally rectangular front 40 and rear 30 walls which are pivotally or flexurally connected at their upper edges and joined along line 22. Housing 20 is, in the preferred embodiment, constructed of a conventional semi-flexible plastic material and will be transparent. With housing 20 being integral and of a plastic material, the common line 22 joining the upper edges of front 40 and rear 30 walls will be the integral joining of such edge at the desired angle $\alpha$, best seen in FIGS. 3 and 6. In an alternate embodiment, for example if housing 20 was constructed of metal, pivot line 22 would be formed with conventional dove-tailing edges of walls 30, 40 with an elongated rod journaled through the dove-tailed edges.

Figure 5:
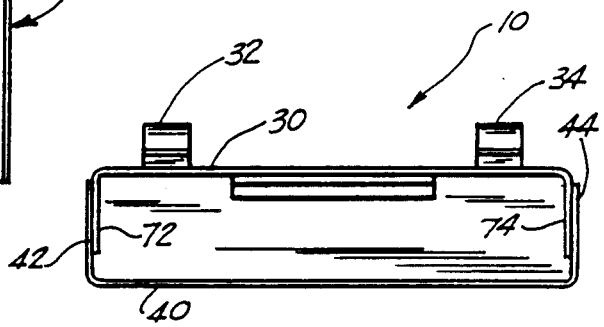
FIG. 5 is a bottom plan view of the embodiment of FIG. 1.
Figure 6:
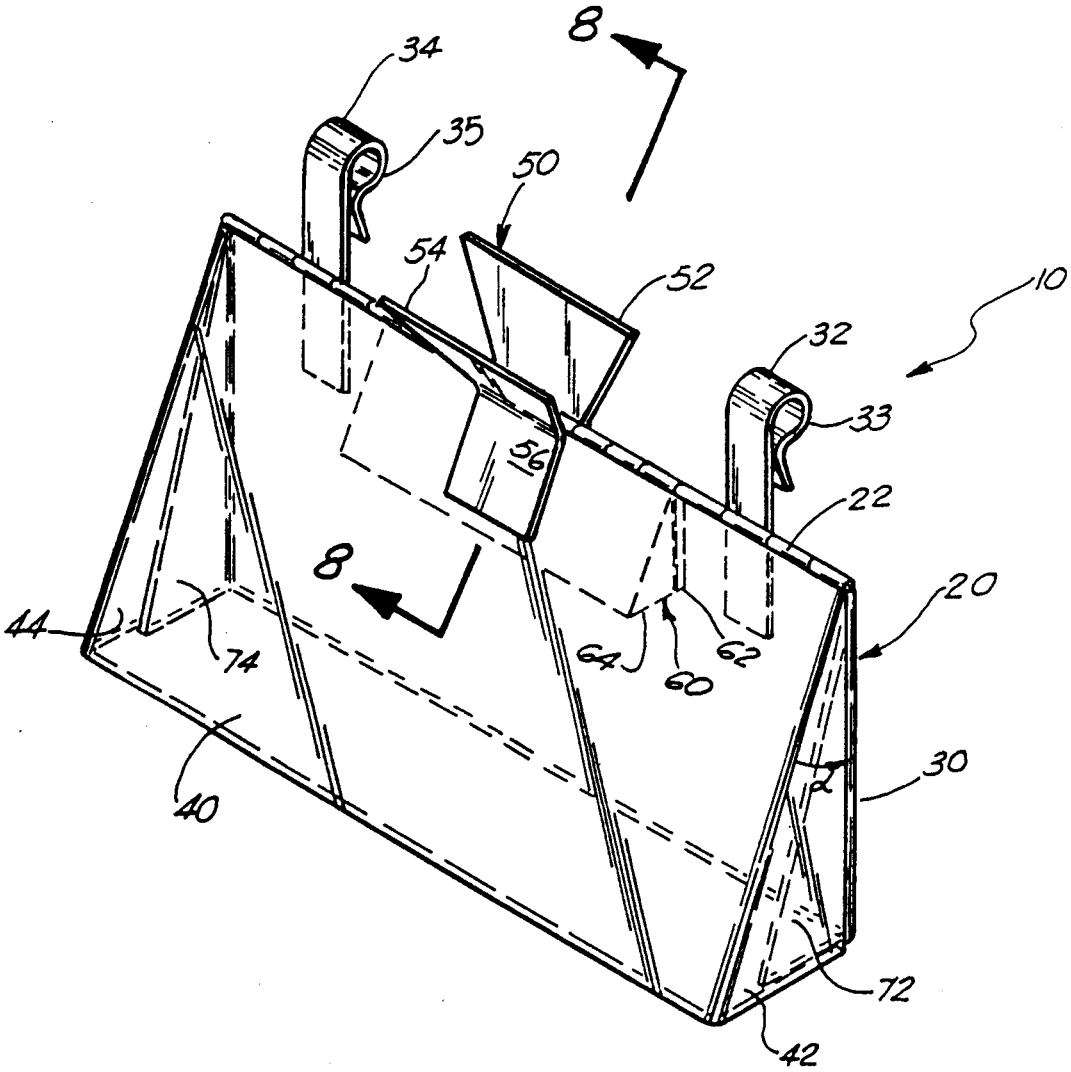
FIG. 6 is a top perspective (transparent) view of the embodiment of FIG. 1.
Figure 9:
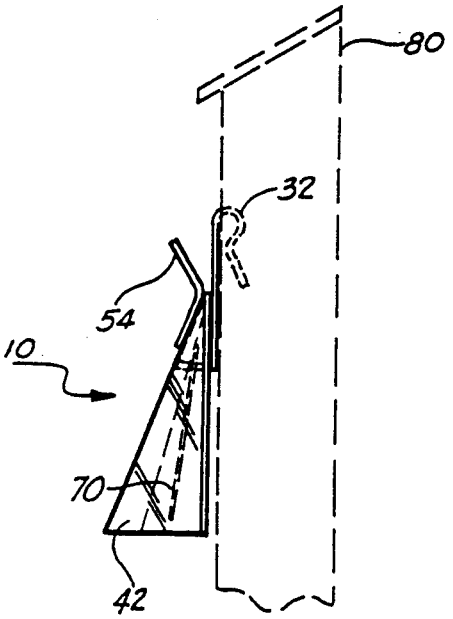
FIG. 9 is a side (transparent) view of the embodiment FIG. 1, adapted to the exterior of a mailbox (provided in phantom); and, FIG. 10 is a side view of the embodiment of FIG. 1 showing the apparatus in its second or "open" position.
Figure 10:
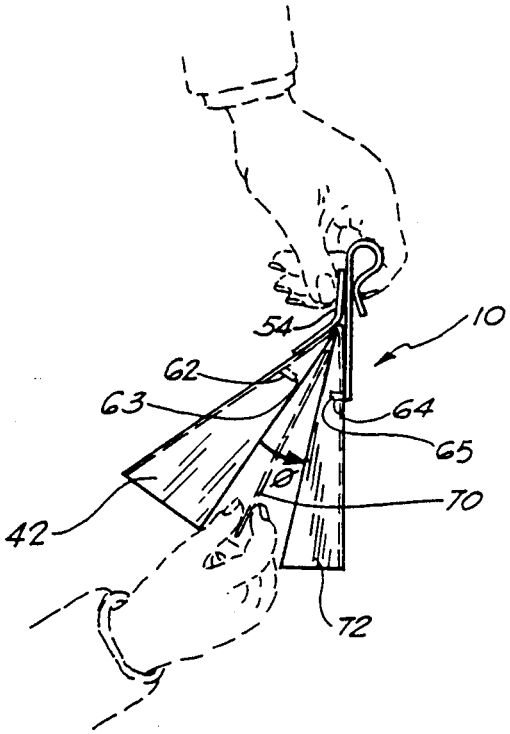

Returning to the preferred embodiment of FIGS. 1–8, housing 20 is of a transparent, plastic material in which front wall 40 and rear wall 30 are integrally pivotally or flexurally attached along common edge 22. As best seen in FIGS. 3, 5, 6 and 10, sidewalls 72, 74 laterally depend inwardly and perpendicularly from each edge of rear wall 30 toward front wall 40. Similarly, sidewalls 42, 44 laterally depend inwardly and perpendicularly from each edge of front wall 40 toward rear wall 30. Thus, when apparatus 10 is in the first or closed position of FIGS. 1–9, sidewall pairs 42, 72 and 44, 74 overlap so that sidewall 72 is interiorly positioned of sidewall 42 within housing 20 and sidewall 74 is interiorly positioned of sidewall 44 within housing 20. Thus, housing 20 is open at the bottom and closed at the top and sides. In this way, as best seen in FIG. 5, 6 and 10, access can be gained to the interior of housing 20 yet articles of mail 70 within housing 20 are protected from the elements.

Figure 3:
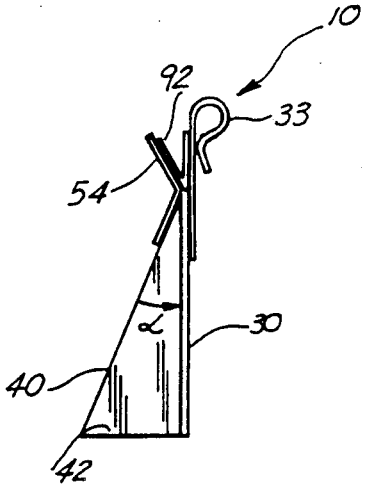
FIG. 3 is a side elevational view of the embodiment of FIG. 1.
Figure 4:
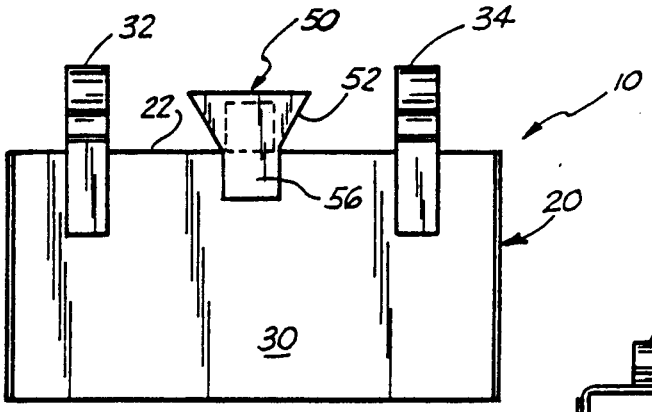
FIG. 4 is a rear elevational view of the embodiment of FIG. 1.
Figure 8:
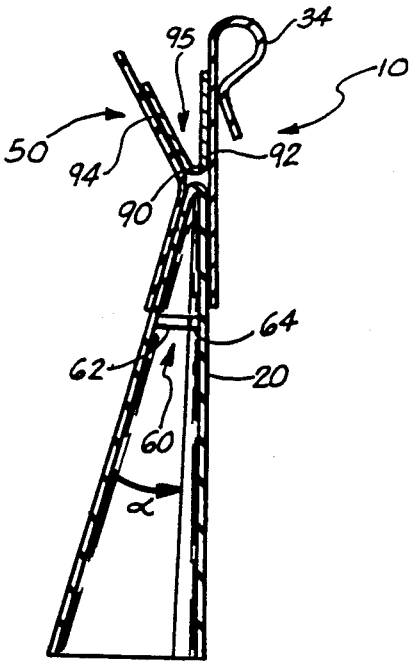
FIG. 8 is a cross-sectional view taken along Line 8—8 of FIG. 6.
Figure 7:
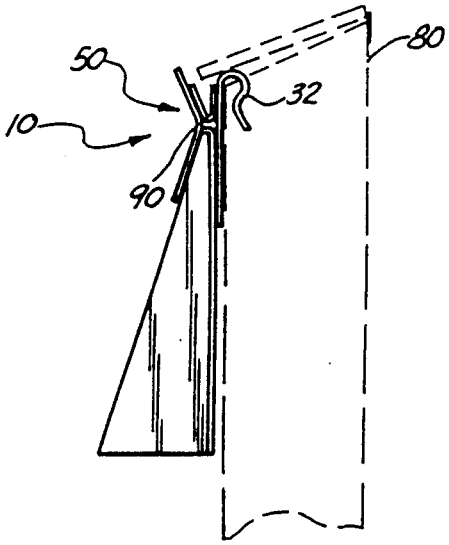
FIG. 7 is a side view of the embodiment of FIG. 1, adapted to the exterior of a mailbox (provided in phantom)

In the preferred embodiment, housing 20 is of a plastic material with front and rear walls 30, 40 integrally attached along common edge 22, this integral construction will provide housing 20 with a natural biasing to the position illustrated in FIGS. 1–9, wherein sidewall pairs 42, 72 and 44, 74 overlap, as best illustrated in FIG. 6. Means 50 is provided for biasing or urging front 40 and rear 30 walls apart, to a second or open position, best illustrated in FIG. 10. Biasing means 50 includes stems 52, 54 which have lower portions 56, 58, respectively, which are fixedly attached to the central upper portions of front 40 and rear 30 walls, respectively, and separated above walls 30, 40 so that they may be drawn together in the manner illustrated in FIG. 10. With stems 52, 54 fixedly attached to walls 30, 40, respectively, when they are drawn together in the manner illustrated in FIG. 10, wall 40 must pivot or flex relative to wall 30 about common edge 22, thereby moving sidewalls 42, 44 relative to sidewalls 72, 74, respectively, and creating a gap illustrated by the angle $\theta$, best seen in FIG. 10. As best seen in FIGS. 3, 7 and 8, a biasing means or wedge spring 95 can be implemented as additional means for biasing or urging housing 20 to the first or closed position of FIGS. 1–9. Spring 95, as is conventionally known, provides a general U-shape or V-shape with integral base 90 and extending sides 92, 94 which provide the bias against which action must be taken to move stems 52, 54 towards each other to in turn move front wall 40 away from rear wall 30 to the second or open position of FIG. 10.

Housing 20 further provides a means 60 for detachably securing or clamping an article of mail in a suspended position therein and is best illustrated in FIGS. 6, 8 and 10. Means 60 comprises a pair of opposed projections 62, 64 extending laterally interiorly from walls 30, 40, respectively, in a manner so that their edges 63, 65 are pressed in resilient contact by the natural bias or by biasing means 95. The resilient contact is maintained by the natural bias of housing 20 or biasing means 95 so as to normally maintain edges 63, 65 of protrusions 62, 64 in resilient contact. The edges 63, 65 may be serrated so that the teeth (not shown) of edge 63 matingly engage the teeth of edge 65 and vice-versa. The edges 63, 65 of protrusions 62, 64 may be conveniently temporarily spread for the insertion of an article of mail 70, as best seen in FIGS. 9 and 10, by pressing the stem portions 52, 54 of biasing means 50 toward each other for a sufficient distance to freely permit insertion of an edge portion of mail 70 therebetween. When pressure on stem portions 52, 54 is then released, edges 63, 65 will re-engage and the article of mail 70 will be securely, but releasably, held by securing or clamping means 60.

As best seen in FIGS. 7 and 9, apparatus 10 may be mounted to a conventional mailbox 80 by brackets 32, 34 which are fixedly connected at their lower end to rear wall 30 of housing 20. The fixing may be by conventional methods such as integral molding if the material is plastic, welding if the material is metal, fasteners such as nuts, bolts, nails and screws if the housing and fastening means are wood. Brackets 32, 34 are curved at their upper ends to form lip portions 33, 35, as best seen in FIGS. 3 and 6, and the lip portions are hung over the top edge of the sidewall of mailbox 80 so that receptacle 10 can be hanged therefrom.

Because many varying and different embodiments may be made within the scope of the inventive concept herein taught, and because many modifications may be made in the embodiments herein detailed in accordance with the descriptive requirement of the law, it is to be understood that the details herein are to be interprete as illustrative and not in a limiting sense.

What is claimed as the invention is:

1. A receptacle adapted to be mounted on the exterior of a mailbox for protection and retention of articles of mail comprising:
   (a) a housing open at the bottom and of a generally triangular shape in cross-section having:
      i. front and rear walls pivotally connected at their upper edges;
      ii. first sidewalls laterally depending from the side edges of said front wall; and,
      iii. second sidewalls laterally depending from the side edges of said rear wall;
   (b) means for biasing said front and rear walls toward each other to a first position wherein said first and second sidewalls overlap at corresponding side edges of said front and rear walls; and,
   (c) means for detachable securing an article of mail in suspended position within said housing.

2. The receptacle of claim 1, wherein said housing is of a transparent material.

3. The receptacle of claim 1, wherein said means for biasing includes a pair of opposing stems mounted on said front and rear walls intermediate said side edges thereof; and, a generally V-shaped spring provided between said stems.

4. The receptacle of claim 1, wherein said means for detachably securing comprises a pair of opposed projections extending laterally and interiorly from said front and rear walls, said projections having edges which are pressed into resilient contact with each other in said first position of said walls.

5. The receptacle of claim 4, wherein said edges of said opposed projections have serrated surfaces.

6. A receptacle adapted to be mounted on the exterior of a mailbox for protection and retention of articles of mail comprising:
   (a) a hollow, transparent housing open at the bottom and of a generally triangular shape in cross-section having;
      i. generally rectangular front and rear walls pivotally connected at their upper edges;
      ii. first sidewalls laterally depending from the side edges of said front wall; and,
      iii. second sidewalls laterally depending from the side edges of said rear wall;
   (b) means for biasing said front and rear walls toward each other to a first position wherein said first and second sidewalls overlap at corresponding side edges of said front and rear walls; and,
   (c) means for detachably securing an article of mail in suspended position within said housing including opposed projections extending laterally and interiorly from said front and rear walls, said projections having edges which are pressed into resilient contact with each other in said first position of said walls.

7. The receptacle of claim 6, wherein said means for biasing includes a pair of opposing stems mounted on said front and rear walls intermediate said side edges thereof; and, a generally V-shaped spring provided between said stems.

8. The receptacle of claim 6, wherein said edges of said opposed projections have serrated surfaces.

* * * * *